US005935386A

United States Patent [19]

Somervuori

[11] Patent Number: 5,935,386

[45] Date of Patent: Aug. 10, 1999

[54] SUCTION ROLL BOX

[76] Inventor: Martti Somervuori, Takiaiskuja 5, Fin-55800 Imatra, Finland

[21] Appl. No.: 08/981,856

[22] PCT Filed: Jul. 4, 1996

[86] PCT No.: PCT/FI96/00396

§ 371 Date: Jan. 5, 1998

§ 102(e) Date: Jan. 5, 1998

[87] PCT Pub. No.: WO97/03246

PCT Pub. Date: Jan. 30, 1997

[30] Foreign Application Priority Data

Jul. 7, 1995 [FI] Finland ..... 953349

[51] Int. Cl.[6] ..... D21F 3/10; D21F 1/60

[52] U.S. Cl. ..... 162/371; 162/357; 162/369; 492/20

[58] Field of Search ..... 162/357, 368, 162/369, 370, 372, 371; 492/20

[56] References Cited

U.S. PATENT DOCUMENTS

| | | | |
|---|---|---|---|
| 2,520,327 | 8/1950 | Nilson | 162/357 |
| 2,714,839 | 8/1955 | Mazer | 162/369 |
| 3,072,180 | 1/1963 | Jodrey | 162/370 |
| 3,272,692 | 9/1966 | Hayes et al. | 162/370 |
| 3,880,711 | 4/1975 | Hayes, Jr. | 162/372 |
| 4,735,686 | 4/1988 | Skytta | 162/357 |

FOREIGN PATENT DOCUMENTS

| | | | |
|---|---|---|---|
| 1207808 | 2/1960 | France | 162/370 |
| 1005825 | 4/1957 | Germany . | |
| 105061 | 7/1942 | Sweden . | |

*Primary Examiner*—Karen M. Hastings
*Attorney, Agent, or Firm*—Andrus, Sceales, Starke & Sawall

[57] ABSTRACT

Suction box for a machine producing a web containing cellulose fibers, said suction box being placed inside a rotating suction roll (2) provided with a perforated jacket (1), said suction box (3) comprising a suction chamber (4) having a suction inlet (6) placed against the interior surface (5) of the suction roll and a suction connection (7) for creating a negative pressure in the suction chamber and sucking water through the perforations (8) in the suction roll into the suction chamber. The suction inlet (6) is provided with ribs (10) laid in a direction transverse to the direction of rotation (9) of the suction roll (2) and forming suction slits (11) in the longitudinal direction of the suction roll near the interior surface (5) of the suction roll.

6 Claims, 1 Drawing Sheet

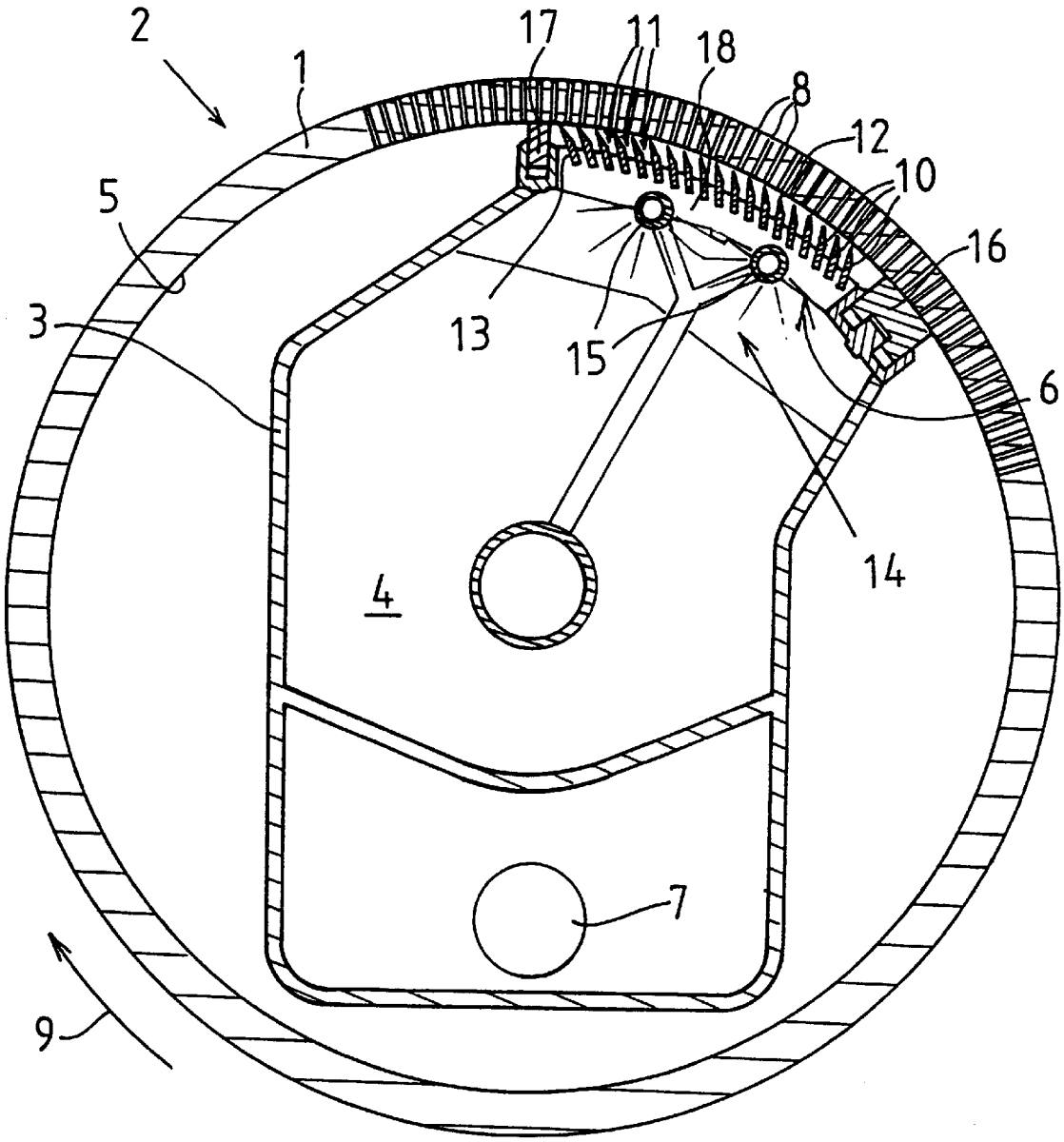
2
1
17
11
18
8
12
10
16
5
3
13
15
6
14
4
7
9

SUCTION ROLL BOX

BACKGROUND OF THE INVENTION

The present invention relates to a suction box as defined in the preamble of claim 1.

In the following, both the invention and prior art are described mainly in connection with paper machines, yet without limiting the invention exclusively to paper machines. Therefore, the term 'paper machine' in this application refers to paper or cardboard machines in general or machines used in pulp manufacture to produce webs containing cellulose fibers.

In paper machines, suction rolls are used for the dewatering of the web being produced, both after the head box and in the press section. A suction roll is a roller with perforations in the whole area of its jacket and with a suction box inside it, the suction box being attached or pressed to the interior surface of the suction roll, with a sealing between them. The purpose of the suction box is to suck water from the web and to draw air through the web to remove moisture from it with the air.

As the machines are operated at increasing speeds, i.e. with increasing speeds of rotation of the rolls, the operation of the suction rolls has become ineffective. A vacuum draws water into the perforations in the suction roll and somewhat into the roll, but the centrifugal force prevents most of the water from entering the suction box itself. The centrifugal force even returns some of the water back into the perforations in the suction rolls and to the outside of the suction roll. For this reason, the water removed from the web remains on the underside of the web, keeping it wet. After the suction stage, the water splashing out from inside the roll again wets the web or, in the press section, the felt. The perforations in the roll contain plenty of water rotating with the roll, and some of this water is also passed to the supply side of the web, wetting the web or the felt. Moreover, the water remaining in the perforations of the roll and the particles contained in the water tend to block the perforations, increasing the power requirement of the suction pumps.

In an attempt to enhance the operation of the suction rolls, the vacuum level in the suction box has been increased, which naturally means an increased power required by the vacuum pumps. This is about the only effect this measure has produced. The increase in the speed of the machines has been achieved by increasing the efficiency of the drying section or by increasing the machine length or the steam consumption.

SUMMARY OF THE INVENTION

The object of the present invention is to eliminate the drawbacks described above. A specific object of the invention is to present a new type of suction box structure which allows more efficient dewatering of a wet web by a suction roll and more efficient drainage of the water from the suction roll into the suction box.

As for the features characteristic of the invention, reference is made to the claims.

The suction box of the invention in a machine for manufacturing a web containing cellulose fibers is inside a rotating suction roll provided with a perforated jacket. The suction box comprises a suction chamber having a suction inlet placed against the interior surface of the suction roll and a suction connection for creating a negative pressure in the suction chamber and drawing water through the perforations in the suction roll into the suction chamber. According to the invention, the suction inlet of the suction box is provided with ribs or slats forming suction slits placed longitudinally relative to the suction roll near its interior surface. Thus, the invention is based on the observation that by reducing the cross-sectional flow area of the suction inlet, the velocity of flow can be increased so that the water drawn through the perforations in the suction roll will continue flowing in the same direction even after the perforations, getting into the slits of the lattice and further into the suction box. Ribs or slats correctly directed also direct the water drops emerging from the perforations towards the suction box.

The ribs preferably form a lattice extending across the whole length and width of the suction inlet, in which lattice the rib comprises a sharp front edge pointing towards the interior surface of the suction roll, which front edge cuts or grabs the water drops emerging from the perforations in the suction roll.

Preferably the sharp front edge of the rib is at a distance from the interior surface of the suction roll; this distance may be e.g. 1–4 mm, preferably 2–3 mm. In another embodiment of the invention, the front edge of the rib is in direct contact with the interior surface of the suction roll, i.e. rubbing the interior surface. This can be implemented via a suitable choice of materials so that the ribs will not damage the interior surface of the suction roll as they rub against it. Thus, the ribs can be provided with front edges made of a softer material which can be replaced and renewed when necessary, or the whole rib may be made of a suitable material that does not damage the interior surface of the suction roll.

The front surface of the rib, which starts from the sharp front edge of the rib and meets the water drops, preferably forms an angle exceeding 90° to the interior surface of the suction roll. In this way, the water drops will not hit the ribs from a perpendicular direction, but instead they meet the ribs at an oblique angle, which means that, while the kinetic energy of the water drops is partially maintained, their direction of movement is turned towards the suction box.

In a preferred embodiment of the invention, the suction inlet of the suction box is provided with a cooling device which cools down the water and vapour drawn by the suction, naturally resulting in a pressure drop and an increased suction effect in the suction inlet of the suction box.

Preferably the cooling device is formed by water spraying jets placed near the ribs, by means of which a fine water jet is directed in a desired direction, preferably in a direction away from the jacket of the suction roll and mainly towards the suction chamber of the suction box.

The suction box of the invention has significant advantages as compared with prior art. By applying the invention, water can be removed with considerable efficiency from a web to be dried, and the water absorbed into the suction roll can be removed from it without letting the water get back into the web being dried. According to preliminary tests carried out, it is possible to increase the solids content of the web after the suction roll by about 2% by using a lattice without a cooling device. Thus, the suction box of the invention has a significant positive effect on the energy consumption of a paper machine, on the quality and properties of the paper and on the speed of the machine.

DETAILED DESCRIPTION OF THE INVENTION

In the following, the invention is described in detail by referring to the attached drawing, which presents a diagrammatic cross-section of a suction box as provided by the invention.

The drawing presents a sectional view of a suction roll 2, which is formed by a round jacket 1 which may have a length of several metres, e.g. 5–10 m. The whole jacket 1 is provided with perforations 8 placed at even distances throughout its circumference and length, although the drawing shows perforations only in a part of the jacket. Inside the suction roll is a suction box 3, which comprises a suction chamber 4, a suction inlet 6 open against the interior surface of the suction roll, and a suction connection 7 for creating a vacuum in the suction chamber 4.

The edges of the suction inlet 6 are provided seals 16 and 17 which are pressed against the interior surface 5, and the ends of the suction inlet are also provided with corresponding seals, so the suction inlet as a whole is pressed relatively tightly against the interior surface 5 of the suction roll. Therefore, the vacuum present in the suction chamber 4 can only cause a suction through the perforations 8 in the suction roll. The seals 16 and 17 may consist of sealing structures known in themselves, e.g. sealing structures tightened against the interior surface 5 by means of compressed air.

Disposed at a distance from each other in the suction inlet 6 are a number of elongated ribs 10, laid in a direction transverse to the direction 9 of rotation of the suction roll and extending through the whole length of the suction inlet. The ribs form a lattice covering the entire suction inlet, so there are a large number of elongated suction slits 11 side by side in the suction inlet. The ribs are attached to a common support 18 and they have sharp front edges 12 pointing towards the interior surface 5 of the suction roll. The sharp edges are at a short distance from the interior surface 5. In addition, the ribs are mounted in an oblique position so that the front surface 13 starting from the sharp front edge 12 forms an angle of over 90° to the interior surface 5 of the suction roll.

Moreover, the suction box is provided with two pipes extending through the whole length of the suction inlet 6, placed near the suction inlet 6 below the lattice formed by the ribs, said pipes constituting a cooling device 14. The pipes are provided with jets or holes, directed away from the suction roll 2 and the lattice formed by the ribs 10, i.e. mainly towards the suction chamber 4.

The action of the suction box illustrated by the drawing is as follows. The wire, and on top of it the web to be dewatered by the suction roll, moves around the rotating suction roll. The negative pressure in the suction box 3 produces a suction in the perforations 8 via the suction inlet 6, causing water to be absorbed from the web and the wire into the perforations 8 opposite to the suction inlet 6. The water flows through the perforations onto the interior surface 5 of the suction roll, where the lattice formed by the ribs 10 reduces the cross-sectional flow area of the suction inlet 6 so that a relatively intensive suction flow continues further through the suction slits 11 towards the suction chamber 4. As the water drops on the interior surface 5 of the suction roll simultaneously hit the sharp front edges 12 of the ribs, the water drops, directed by the ribs in the suction flow, are passed on into the suction box.

As the web being treated is relatively warm and the negative pressure is relatively high, a significant proportion of the water to be removed by suction is in the form of steam. For this reason, a cooling device 14 is provided below the ribs to cool down the steam flow, thus condensing the steam into water and producing a considerable pressure drop in the suction inlet below the ribs. This further enhances the suction effect on the suction roll in the suction inlet area and therefore also the dewatering effect.

In the foregoing, the invention has been described via an example by referring to the attached drawing, but different embodiments of the invention are possible within the scope of the inventive idea defined by the claims.

I claim:

1. A rotating suction roll, having a perforated jacket, for a machine producing a web containing cellulose fibers, said suction roll having placed inside it a suction box, said suction box (3) comprising a single suction chamber (4) having a single suction inlet (6) having a flow area defined by a pair of spaced seals placed against an interior surface (5) of the suction roll perforated jacket and a suction connection (7) for creating a negative pressure in the suction chamber and sucking water through the perforations (8) in the suction roll perforated jacket into the suction chamber, characterized in that the suction inlet (6) is provided with a plurality of stationary ribs (10) laid in a direction transverse to the direction of rotation (9) of the suction roll (2) to form a lattice extending across the entire width and length of the suction inlet, the plurality of ribs reducing the flow area of the suction inlet and forming suction slits (11) in the longitudinal direction of the suction roll near the interior surface (5) of the suction roll perforated jacket, each of the ribs having a sharp front edge (12) directed toward the interior surface of the suction roll perforated jacket and a front surface extending from the first edge of the rib, the front surface positioned at an angle relative to the radius of the suction roll, wherein the front surface of each rib is tilted away from the radius of the suction roll in the direction of rotation of the suction roll.

2. Suction box as defined in claim 1, characterized in that the front edge (12) of the rib is at a distance from the interior surface (5) of the suction roll.

3. Suction box as defined in claim 1, characterized in that the front edge (12) of each rib is in contact with the interior surface (5) of the suction roll.

4. Suction box as defined in claim 1, characterized in that the suction inlet is provided with a cooling device (14) for cooling down the steam sucked through the perforations (8) in the suction roll (2) and to increase the negative pressure.

5. Suction box as defined in claim 4, characterized in that the cooling device (14) comprises water spraying jets (15) disposed near the ribs.

6. Suction box as defined in claim 5, characterized in that the jets (15) are directed away from the ribs (10) towards the suction chamber (4).

* * * * *